US009689132B2

(12) United States Patent
Han

(10) Patent No.: US 9,689,132 B2
(45) Date of Patent: Jun. 27, 2017

(54) PERMANENT DRAINAGE DITCH ADAPTED TO IMPROVE YIELD FROM FARMLAND

(71) Applicant: Qiuhua Han, Shaoxing (CN)

(72) Inventor: Qiuhua Han, Shaoxing (CN)

( * ) Notice: Subject to any disclaimer, the term of this patent is extended or adjusted under 35 U.S.C. 154(b) by 6 days.

(21) Appl. No.: 14/946,801

(22) Filed: Nov. 20, 2015

(65) Prior Publication Data

US 2016/0076214 A1 Mar. 17, 2016

Related U.S. Application Data

(63) Continuation-in-part of application No. PCT/CN2013/076949, filed on Jun. 7, 2013.

(30) Foreign Application Priority Data

May 22, 2013 (CN) ..... 2013 2 0284885 U

(51) Int. Cl.
*E02B 11/00* (2006.01)
*E02B 13/02* (2006.01)

(52) U.S. Cl.
CPC ..... *E02B 11/005* (2013.01); *E02B 11/00* (2013.01); *E02B 13/02* (2013.01)

(58) Field of Classification Search
CPC ..... E02B 13/02; E02B 11/00
USPC ..... 405/36–51, 103, 104
See application file for complete search history.

(56) References Cited

U.S. PATENT DOCUMENTS 5,306,317 A * 4/1994 Yoshizaki ..... A01G 9/24 405/36
2003/0026658 A1* 2/2003 Wu ..... E02B 7/30 405/87

FOREIGN PATENT DOCUMENTS

CN 2479063 Y * 2/2002
CN 202323901 U * 7/2012

* cited by examiner

*Primary Examiner* — Tara M. Pinnock
(74) *Attorney, Agent, or Firm* — Matthias Scholl, PC; Matthias Scholl

(57) ABSTRACT

A drainage ditch, including: a ditch body. The ditch body includes, from the top down: a separate layer, a first filter layer, a second filter layer, and a third filter layer. The separate layer is straw or stover; the first filter layer is crush stones having particle sizes of between 5 and 15 mm; the second filter layer is crush stones having particle sizes of between 20 mm and 40 mm; the third filter layer is stones having particle sizes of between 30 mm and 70 mm. The separate layer is covered by a plough layer.

5 Claims, 4 Drawing Sheets

PERMANENT DRAINAGE DITCH ADAPTED TO IMPROVE YIELD FROM FARMLAND

CROSS-REFERENCE TO RELATED APPLICATIONS

This application is a continuation-in-part of International Patent Application No. PCT/CN2013/076949 with an international filing date of Jun. 7, 2013, designating the United States, now pending, and further claims priority benefits to Chinese Patent Application No. 201320284885.3 filed May 22, 2013. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to a water supply and drainage system for agricultural production, and more particularly to a permanent drainage ditch adapted to improve the yield from farmland.

Description of the Related Art

Typically, a drainage ditch is disposed on the topsoil of farmland, which occupies a large amount of effective cultivated land. In addition, the drainage ditch requires trenching and filling in at different plantation seasons, which is laborsome and time-consuming, and increases the labor cost. Furthermore, a conventional drainage ditch fails to lower the groundwater table and promote underground air ventilation. Therefore, the crop root system is undeveloped, and the lodging resistance and disease resistance of the crops are poor.

SUMMARY OF THE INVENTION

In view of the above-described problems, it is one objective of the invention to provide a drainage ditch that features good drainage function, stable and durable structure, and convenient construction. The drainage ditch is trenched in the subsurface soil of farmland, so it occupies no effective cultivated land, which is favorable to increasing the yield of crops.

To achieve the above objective, in accordance with one embodiment of the invention, there is provided a drainage ditch, comprising a ditch body. The ditch body, from the top down, comprises a separate layer, a first filter layer, a second filter layer, and a third filter layer. The separate layer is straw or stover. The first filter layer is crush stones having particle sizes of between 5 and 15 mm; the second filter layer is crush stones having particle sizes of between 20 mm and 40 mm; the third filter layer is stones having particle sizes of between 30 mm and 70 mm. The separate layer is covered by a plough layer.

In a class of this embodiment, a thickness of the separate layer is between 30 and 50 mm. A thickness of the first filter layer is between 100 and 150 mm. A thickness of the second filter layer is between 150 and 200 mm. A thickness of the third filter layer is between 300 and 350 mm.

In a class of this embodiment, the drainage ditch is arranged in a crisscross pattern. The width of the ditch body is between 220 mm and 400 mm. A gap between longitudinal members of the ditch body is between 25 m and 40 m. A gap between transverse members of the ditch body is between 30 m and 50 m.

In a class of this embodiment, the drainage ditch comprises a water outlet and a water inlet; the water outlet and the water inlet communicate with an outfall or an estuary; water outlets and water inlets of drainage ditches of neighboring farmland communicate with each other; the water inlet and water outlet are each provided with a regulating gate valve.

In a class of this embodiment, the regulating gate valve comprises a gate, a valve core, and a spanner; the gate comprises a hollow cylindrical sleeve in the middle thereof; a top of the hollow cylindrical sleeve is open and a bottom thereof is closed; the hollow cylindrical sleeve comprises a pair of opposite holes at a lower part thereof; the valve core is cylindrical and matches the hollow cylindrical sleeve, and an outer wall of the valve core is corresponding to an inner wall of the hollow cylindrical sleeve; the valve core is slightly higher than the hollow cylindrical sleeve of the gate, and a valve head stretches from a top of the valve core; a cross section of the valve head is a polygon; a lower part of the valve core is provided with a through hole; when the valve core is inserted in the hollow cylindrical sleeve, the through hole at the lower part of the valve core and the pair of holes of the hollow cylindrical sleeve are at the same height; when the valve core is rotated at an appropriate angle, the through hole and the pair of holes communicate with each other; and when the valve core is rotated at another angle, the communication of the through hole and the pair of holes is blocked.

In a class of this embodiment, the spanner comprises a polygonal opening having a cross section corresponding to the cross section of the valve head.

In a class of this embodiment, the regulating gate valve is wider than the ditch body.

Compared with existing technologies, advantages of the permanent drainage ditch adapted to improve the yield from farmland according to embodiments of the invention are given below:

1. The drainage ditch comprises several filter layers, so it can timely lower the groundwater level of farmland, and facilitates the ventilation, both of which are beneficial to the crops to form developed root system, thus improving the lodging resistance and disease resistance, and increasing the crop yield.

2. The drainage ditch is made of different specifications of stones, so it is sturdy and durable. Once the drainage ditch is constructed, it can work for hundreds of years, thus saving a large amount of labor and time.

3. The drainage ditch occupies no effective cultivated land, thus bringing much convenience to agricultural mechanization and agricultural modernization, and increasing the crop yield.

4. The raw materials for constructing the drainage ditch are easily available and cheap, and the construction process is simple, so it has wide adaptability and practicability.

5. Using the drainage ditch, the polluted and poisonous water containing chemical fertilizers and pesticides is not directly discharged into the rivers, so that the rivers and lakes are more clear and safe, so the drainage ditch is environmentally friendly and exhibits great significance for the health of human beings.

In the figures, the following reference numbers are used: 1. Ditch body; 11. Separate layer; 12. First filter layer; 13. Second filter layer; 14. Third filter layer; 2. Regulating gate valve; 21. Gate; 3. Valve core; 4. Spanner; 22. Hollow cylindrical sleeve; 23. Pair of holes; 31. Valve head; 32. Through hole; 41. Polygonal opening.

DETAILED DESCRIPTION OF THE EMBODIMENTS

For further illustrating the invention, experiments detailing a permanent drainage ditch adapted to improve the yield from farmland are described below. It should be noted that the following examples are intended to describe and not to limit the invention.

Figure 1:
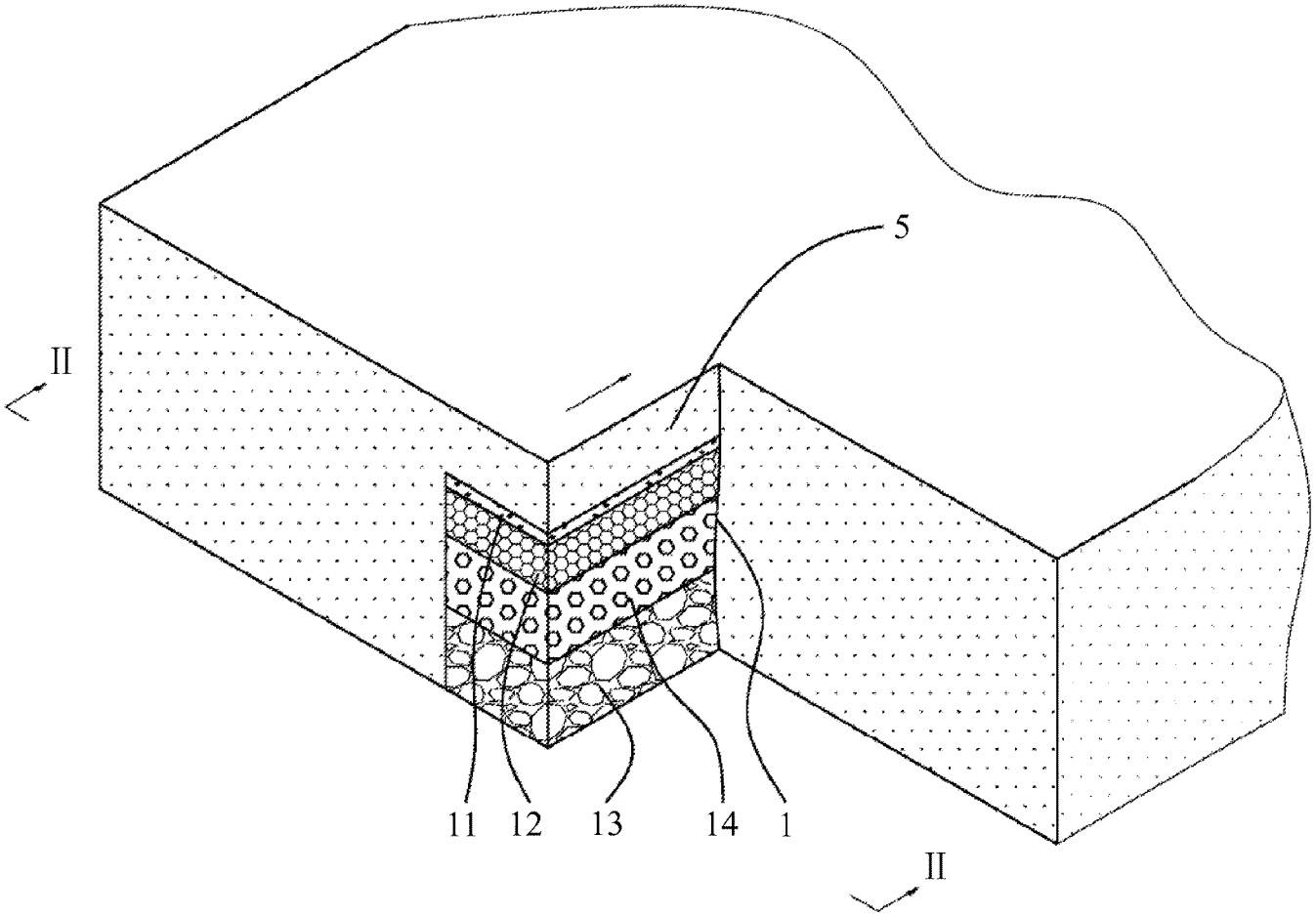
FIG. 1 is an axonometric sectional view of a permanent drainage ditch adapted to improve the yield from farmland in accordance with one embodiment of the invention.
Figure 2:
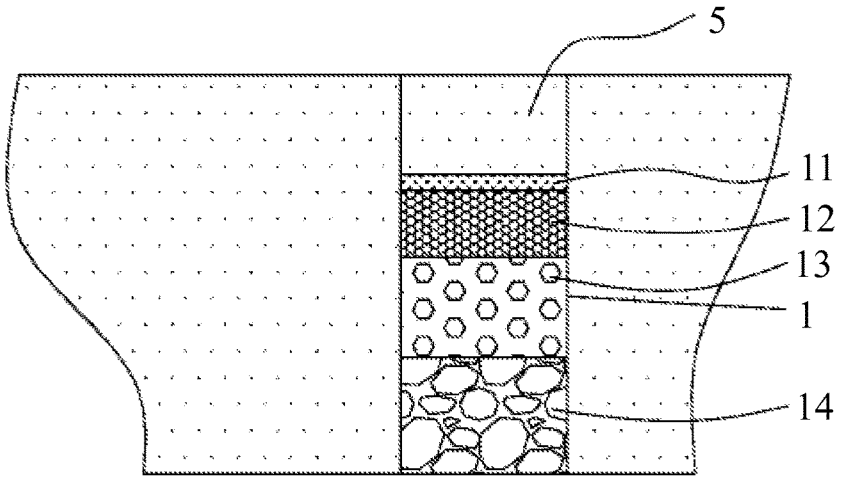
FIG. 2 is a cross-sectional view taken from line II-II in FIG. 1 in accordance with one embodiment of the invention.
Figure 3:
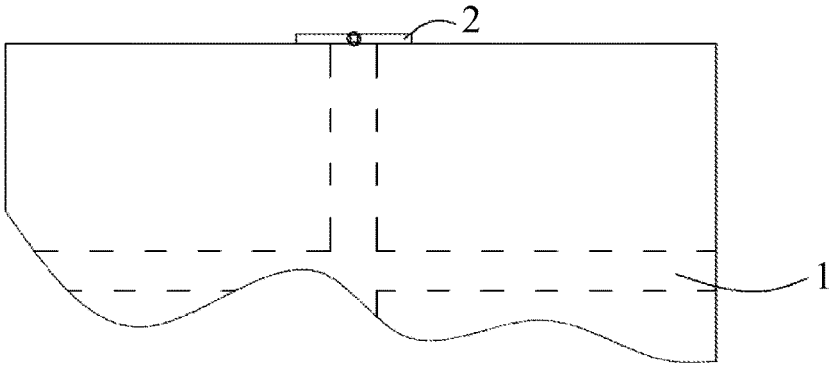
FIG. 3 is a top view showing a distribution of a drainage ditch with a gate valve in farmland in accordance with one embodiment of the invention.

As shown in FIGS. 1-3, a permanent drainage ditch adapted to improve the yield from farmland, comprises a ditch body 1, a water outlet and a water inlet. The ditch body comprises four filter layers from the top down, specifically, a separate layer 11, a first filter layer 12, a second filter layer 13, and a third filter layer 14. The separate layer 11 is covered by a plough layer 5. The separate layer 11 is straw or stover, and a thickness of the separate layer is between 30 and 50 mm. The separate layer 11 is adapted to filter sediments and impurities, so that the sediments are prevented from penetrating into the first filter layer 12 and thus the blockage of the first filter layer 12 is avoided. The first filter layer 12 is disposed under the separate layer 11. The first filter layer 12 is crush stones having particle sizes of between 5 and 15 mm, a thickness of the first filter layer is between 100 and 150 mm so as to prevent the sediments from flowing down and to guarantee a smooth flow of water. Under the first filter layer 12 is provided with the second filter layer 13. The second filter layer 13 is crush stones having particle sizes of between 20 mm and 40 mm, and a thickness of the second filter layer is between 150 and 200 mm. The stones are provided with wider gaps to guarantee a smooth flow of water. Under the second filter layer 13 is provided with the third filter layer 14. The third filter layer 14 is stones having particle sizes of between 30 and 70 mm, and a thickness of the third filter layer is between 300 and 350 mm. The stones are also provided with wider gaps to guarantee a smooth flow of water.

FIG. 3 is a top view of the distribution of the drainage ditch in farmland and an installation of a gate valve. As shown by FIG. 3, dotted lines show the distribution of the ditch body 1 in a farmland. The water inlet and the water outlet of the drainage ditch are determined by the distribution of channels and rivers, and the height of the terrain. The water outlet and the water inlet communicate with an outfall or an estuary; water outlets and water inlets of drainage ditches of neighboring farmland communicate with each other; the water inlet and water outlet are each provided with a regulating gate valve. The water inlet and water outlet which are along the outfall, along the estuary, or at high fall between filed blocks in the farmland are provided with a regulating gate valve or a mud dam to intercept water or drain water. The ditch body 1 is completely covered by the plough layer 5, occupying no cultivated land.

Figure 4:
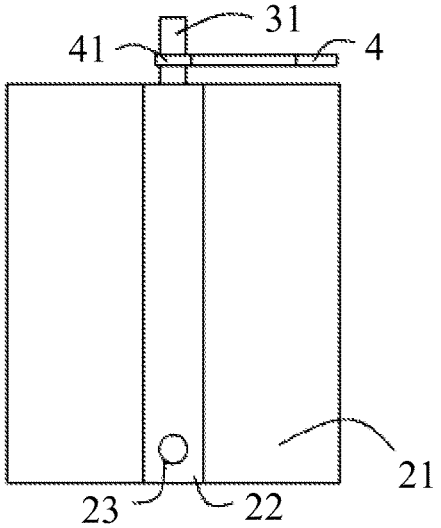
FIG. 4 is a front view of a regulating gate valve of a permanent drainage ditch adapted to improve the yield from farmland in accordance with one embodiment of the invention.
Figure 5:
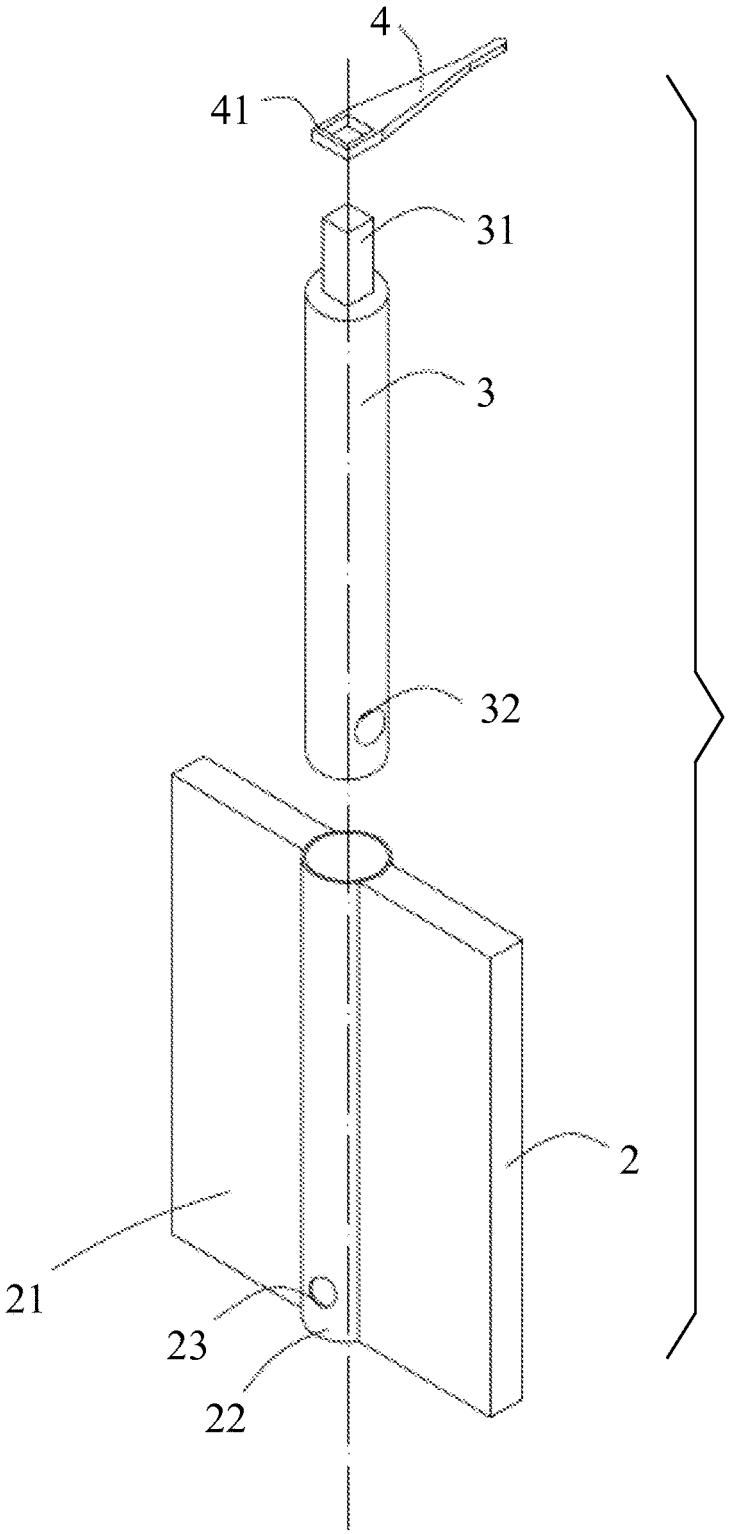
FIG. 5 is an exploded view of FIG. 4.
Figure 6:
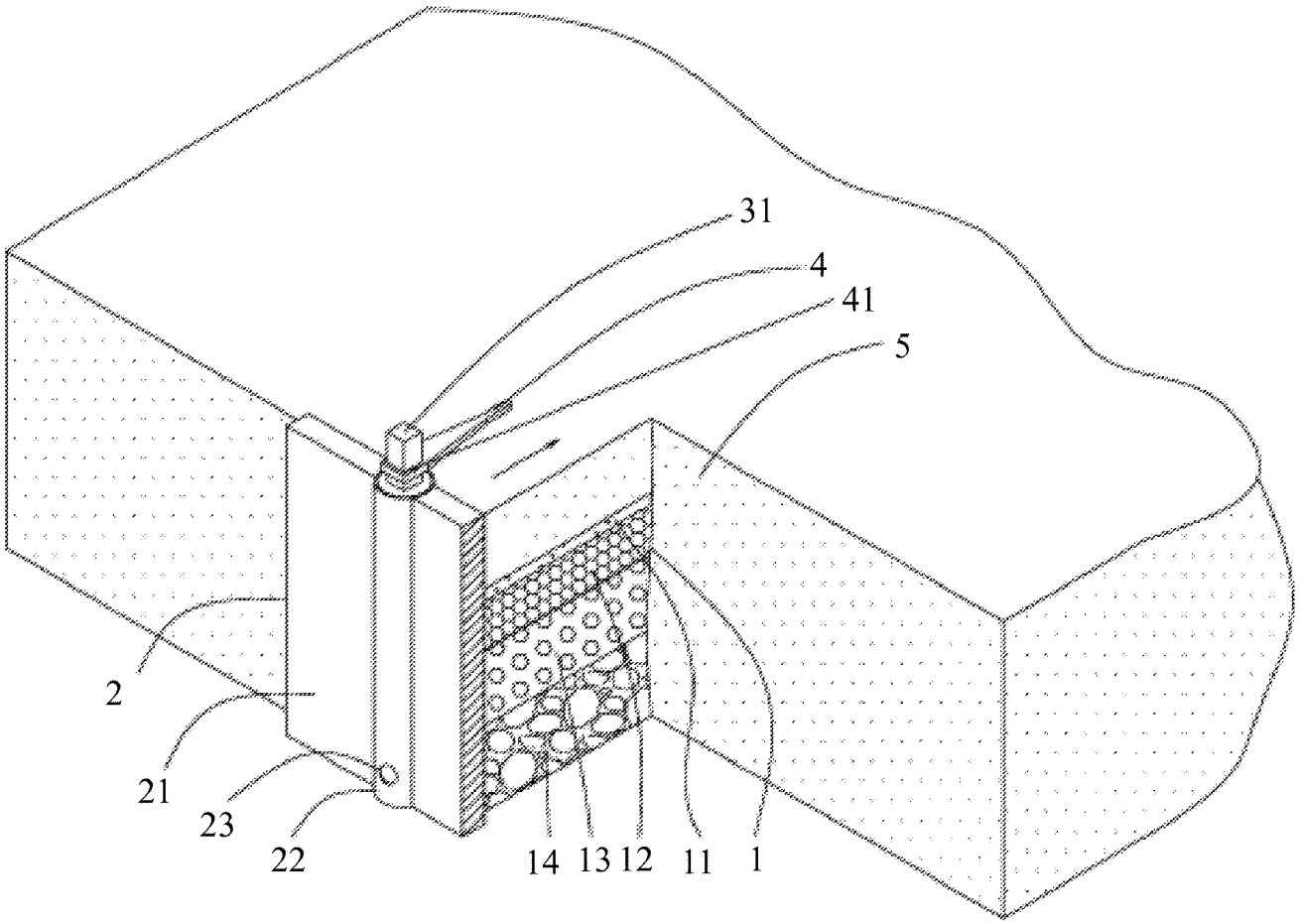
FIG. 6 is a diagram showing a use state of a permanent drainage ditch adapted to improve the yield from farmland in accordance with one embodiment of the invention.

As shown in FIGS. 4-6, the regulating gate valve 2 of the permanent drainage ditch comprises a gate 21, a valve core 3, and a spanner 4. In the middle of the gate 21 is provided with a hollow cylindrical sleeve 22. The hollow cylindrical sleeve 22 is open on the top and closed at the bottom. At the lower part of the hollow cylindrical sleeve 22 is provided with a pair of opposite holes 23. The valve core 3 is cylindrical and matches the hollow cylindrical sleeve 22. An outer wall of the valve core is corresponding to an inner wall of the hollow cylindrical sleeve 22 of the gate 21. The valve core 3 is slightly higher than the hollow cylindrical sleeve 22 of the gate 21, and a valve head 31 stretches from a top of the valve core 3. The cross section of the valve head 31 is a polygon, possibly being a square or a hexagon. A lower part of the valve core 3 is provided with a through hole 32. When the valve core 3 is inserted in the hollow cylindrical sleeve 22, the through hole 32 at the lower part of the valve core 3 and the pair of holes 23 of the hollow cylindrical sleeve 22 are at the same height. The valve core 3 is adapted to rotate to control the communication between the through hole 32 and the pair of holes 23. Specifically, when the valve core is rotated at an appropriate angle, the through hole and the pair of holes communicate with each other; and when the valve core is rotated at another angle, the communication of the through hole and the pair of holes is blocked. The spanner 4 comprises a polygonal opening 41 having a cross section corresponding to the cross section of the valve head 31. The regulating gate valve 2 is wider than the ditch body 1, so as to ensure that the regulating gate valve 2 is able to cut off the water flow in the ditch body 1.

In practice, the width of the ditch body 1 is between 220 mm and 400 mm, and can be higher or lower according to actual needs. Preferably, the width is 220 mm, and is no more than 500 mm, because when the ditch body is too broad, the weight load of a single tire of a tractor and the like farming machines is totally on the ditch body, thus causing damage to the ditch body. The ditch body 1 is arranged in a crisscross pattern. A gap between longitudinal members of the ditch body is between 25 m and 40 m. A gap between transverse members of the ditch body is between 30 m and 50 m. The gap being too wide influences the drainage effect, and the gap being too narrow adds to the amount of construction. For a better construction quality, the drainage ditch is constructed after harvest in autumn and before plowing of next season, during which the groundwater level is at the lowest. In use, excess water in the ground penetrates via the plough layer 5 into the third filter layer 14, and is discharged downstream via the water outlet. Meanwhile, the regulating gate valve 2 controls the water level, and when the water level becomes too low, the water inlet is opened to introduce irrigation water.

Unless otherwise indicated, the numerical ranges involved in the invention include the end values.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A drainage ditch, comprising a ditch body, a water outlet, and a water inlet; the ditch body, from the top down, comprising a separate layer, a first filter layer, a second filter layer, and a third filter layer; the water outlet and the water inlet each comprising a regulating gate valve; and the regulating gate valve comprising a gate, a valve core, and a spanner;

wherein the separate layer is straw or stover; the first filter layer is crush stones having particle sizes of between 5 and 15 mm; the second filter layer is crush stones having particle sizes of between 20 mm and 40 mm; the third filter layer is stones having particle sizes of between 30 mm and 70 mm;

the separate layer is covered by a plough layer;

the water outlet and the water inlet communicate with an outfall or an estuary;

the gate comprises a hollow cylindrical sleeve in the middle thereof;

a top of the hollow cylindrical sleeve is open and a bottom thereof is closed; the hollow cylindrical sleeve comprises a pair of opposite holes at a lower part thereof;

the valve core is cylindrical and matches the hollow cylindrical sleeve, and an outer wall of the valve core is corresponding to an inner wall of the hollow cylindrical sleeve;

the valve core is higher than the hollow cylindrical sleeve of the gate, and a valve head stretches from a top of the valve core; a cross section of the valve head is a polygon; a lower part of the valve core is provided with a through hole;

when the valve core is inserted in the hollow cylindrical sleeve, the through hole at the lower part of the valve core and the pair of holes of the hollow cylindrical sleeve are at the same height; and when the valve core is rotated at an appropriate angle, the through hole and the pair of holes communicate with each other; and when the valve core is rotated at another angle, the communication of the through hole and the pair of holes is blocked.

2. The drainage ditch of claim 1, wherein a thickness of the separate layer is between 30 and 50 mm; a thickness of the first filter layer is between 100 and 150 mm; a thickness of the second filter layer is between 150 and 200 mm; a thickness of the third filter layer is between 300 and 350 mm.

3. The drainage ditch of claim 1, wherein the drainage ditch is arranged in a crisscross pattern; a width of the ditch body is between 220 mm and 400 mm; a gap between longitudinal portions of the crisscross pattern is between 25 m and 40 m; a gap between transverse portions of the crisscross pattern is between 30 m and 50 m.

4. The drainage ditch of claim 1, wherein the spanner comprises a polygonal opening having a cross section corresponding to the cross section of the valve head.

5. The drainage ditch of claim 1, wherein the regulating gate valve is wider than the ditch body.

* * * * *